US005311675A

United States Patent [19]

Topel

[11] Patent Number: 5,311,675

[45] Date of Patent: May 17, 1994

[54] HIGH HEEL SHOE CAP

[76] Inventor: Tracy L. Topel, Rte. 1, Box 1396, Granby, Mo. 64844

[21] Appl. No.: 58,143

[22] Filed: May 10, 1993

[51] Int. Cl.[5] ..... A43B 13/22

[52] U.S. Cl. ..... 36/72 B; 36/72 R

[58] Field of Search ..... 36/72 B, 72 R

[56] References Cited

U.S. PATENT DOCUMENTS

| | | | |
|---|---|---|---|
| 1,261,525 | 4/1918 | Helwitz | 31/72 B |
| 1,263,555 | 4/1918 | Helwitz | 36/72 B |
| 1,346,709 | 7/1920 | Helwitz | 36/72 B |
| 1,875,806 | 9/1932 | Givens | 36/72 B |
| 2,875,534 | 3/1959 | Grossman | 36/72 B |
| 3,122,848 | 3/1964 | Grossman | 36/72 B |
| 3,150,453 | 9/1964 | Tilden | 36/72 B |
| 3,439,435 | 4/1969 | Fredon | 36/72 R |
| 4,525,940 | 7/1985 | Mochizuki | 36/116 |

FOREIGN PATENT DOCUMENTS

| | | | |
|---|---|---|---|
| 239666 | 12/1959 | Australia | 36/72 B |
| 565520 | 3/1958 | Belgium | 36/72 B |
| 2025993 | 12/1971 | Fed. Rep. of Germany | 36/72 B |
| 666085 | 9/1929 | France | 36/72 B |
| 74359 | 9/1960 | France | 36/72 B |
| 800501 | 8/1958 | United Kingdom | 36/72 B |

*Primary Examiner*—Steven N. Meyers
*Attorney, Agent, or Firm*—Leon Gilden

[57] ABSTRACT

A shoe cap arranged for securement to and for reception of a lady's high heel shoe permitting extended support of the shoe for traverse of water moistened and soft turf.

3 Claims, 4 Drawing Sheets

FIG. 3
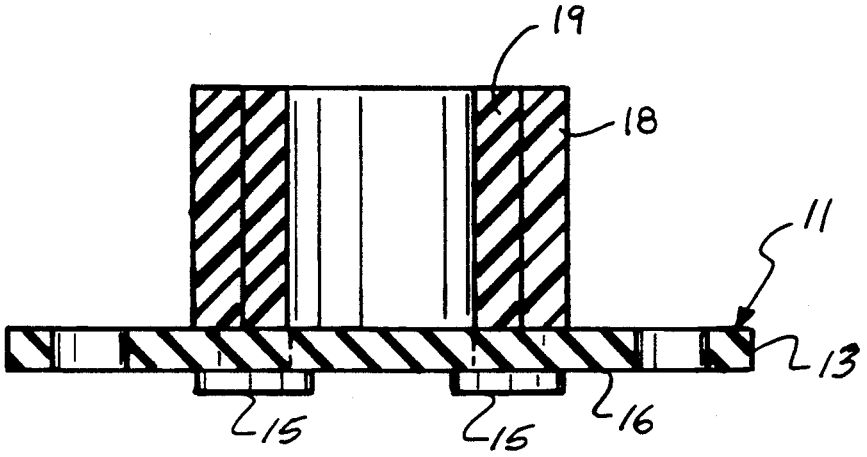
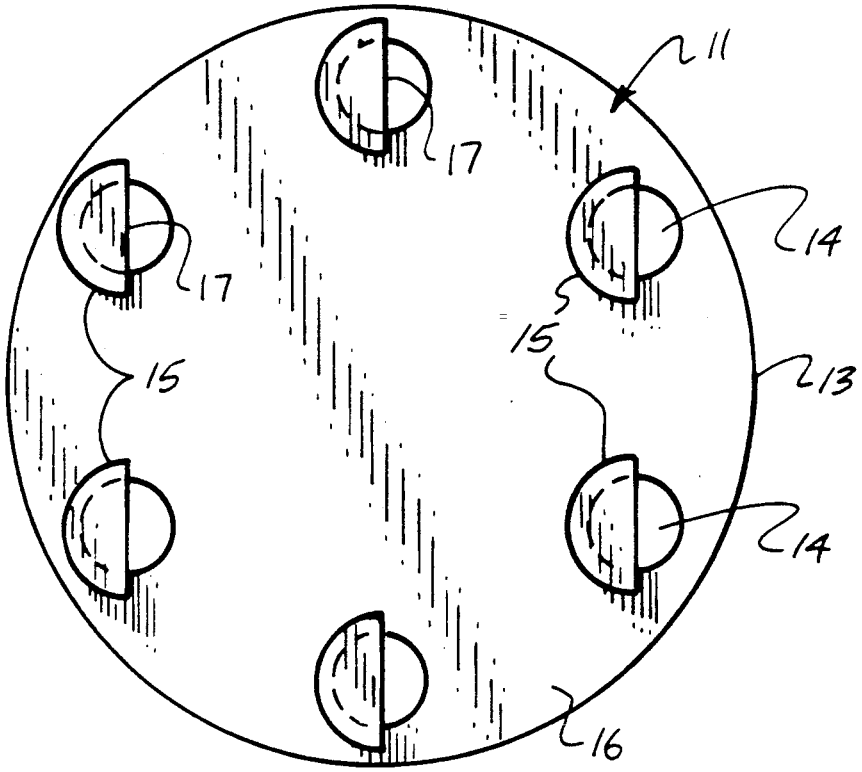
FIG. 4

FIG. 5
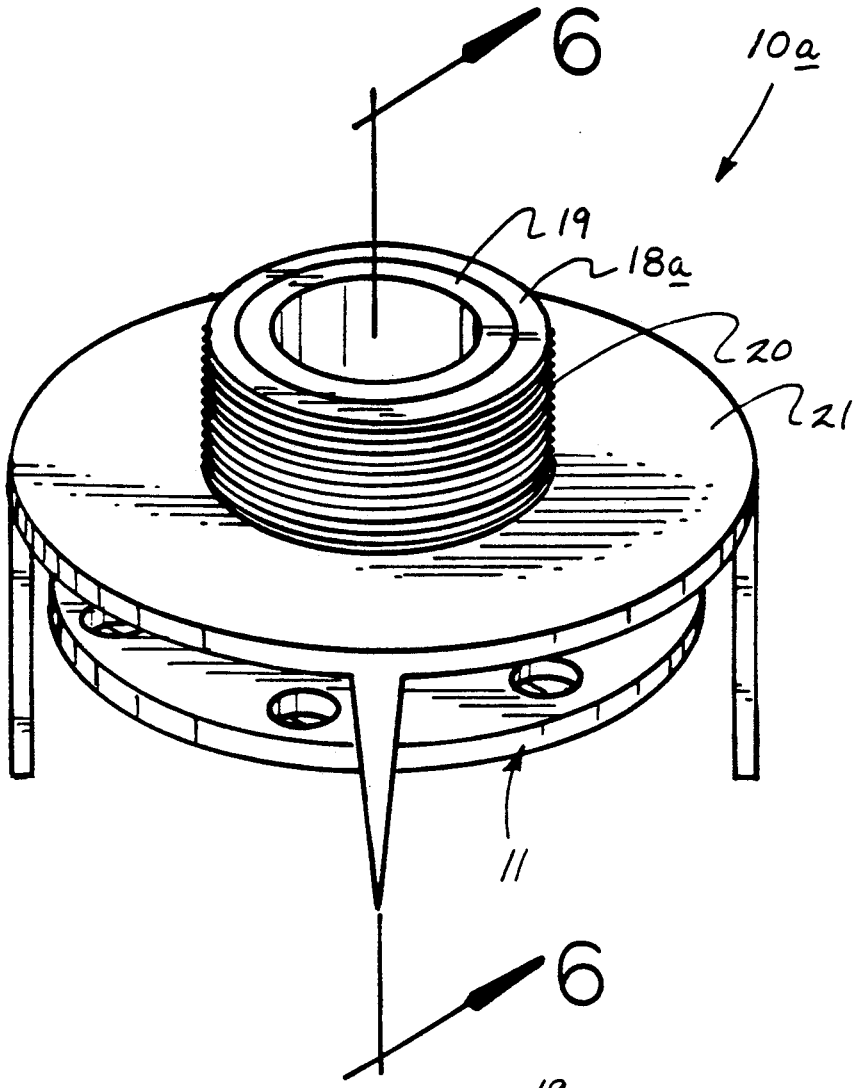
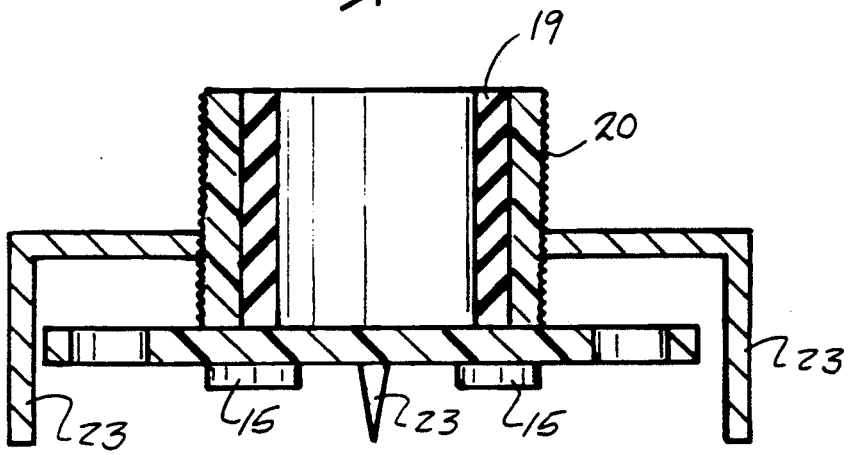
FIG. 6

HIGH HEEL SHOE CAP

BACKGROUND OF THE INVENTION

1. Field of the Invention

The field of invention relates to shoe accessory apparatus, and more particularly pertains to a new and improved high heel shoe cap wherein the same is directed to the protection and support of a lady's high heel shoe.

2. Description of the Prior Art

In the use of high heel shoes, and particularly when high heel shoes are worn in an outdoors environment, subsequent to a rain and the like, a water soaked ground affords comparatively little support to a lady's shoe having a conventional high heel. To this end, the instant invention attempts to overcome deficiencies of the prior art by providing for a cap member readily mounted and removed relative to a high heel portion of a lady's shoe to provide for enhanced support to the individual when traversing such water soaked turf. Examples of heel protectors for ladies' shoes exemplified in the U.S. Pat. Nos. 4,756,097; 4,727,659; and 4,872,271.

SUMMARY OF THE INVENTION

In view of the foregoing disadvantages inherent in the known types of high heel shoe accessory structure now present in the prior art, the present invention provides a high heel shoe cap arranged to receive a high heel portion of a lady's shoe to provide for enhanced support of the associated shoe structure. As such, the general purpose of the present invention, which will be described subsequently in greater detail, is to provide a new and improved high heel shoe cap which has all the advantages of the prior art high heel protector structure and none of the disadvantages.

To attain this, the present invention provides a shoe cap arranged for securement to and for reception of a lady's high heel shoe permitting extended support of the shoe for traverse of water moistened and soft turf.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved high heel shoe cap which has all the advantages of the prior art high heel protector structure and none of the disadvantages.

It is another object of the present invention to provide a new and improved high heel shoe cap which may be easily and efficiently manufactured and marketed.

It is a further object of the present invention to provide a new and improved high heel shoe cap which is of a durable and reliable construction.

An even further object of the present invention is to provide a new and improved high heel shoe cap which is susceptible of a low cost of manufacture with regard to both materials and labor, and which accordingly is then susceptible of low prices of sale to the consuming public, thereby making such high heel shoe caps economically available to the buying public.

Still yet another object of the present invention is to provide a new and improved high heel shoe cap which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view, taken along the lines 3—3 of FIG. 1 in the direction indicated by the arrows.

FIG. 4 is an orthographic view, taken along the lines 4—4 of FIG. 2 in the direction indicated by the arrows.

FIG. 5 is an isometric illustration of a modified aspect structure of the invention.

FIG. 6 is an orthographic view, taken along the lines 6—6 of FIG. 5 in the direction indicated by the arrows.

DESCRIPTION OF THE PREFERRED EMBODIMENT

Figure 1:
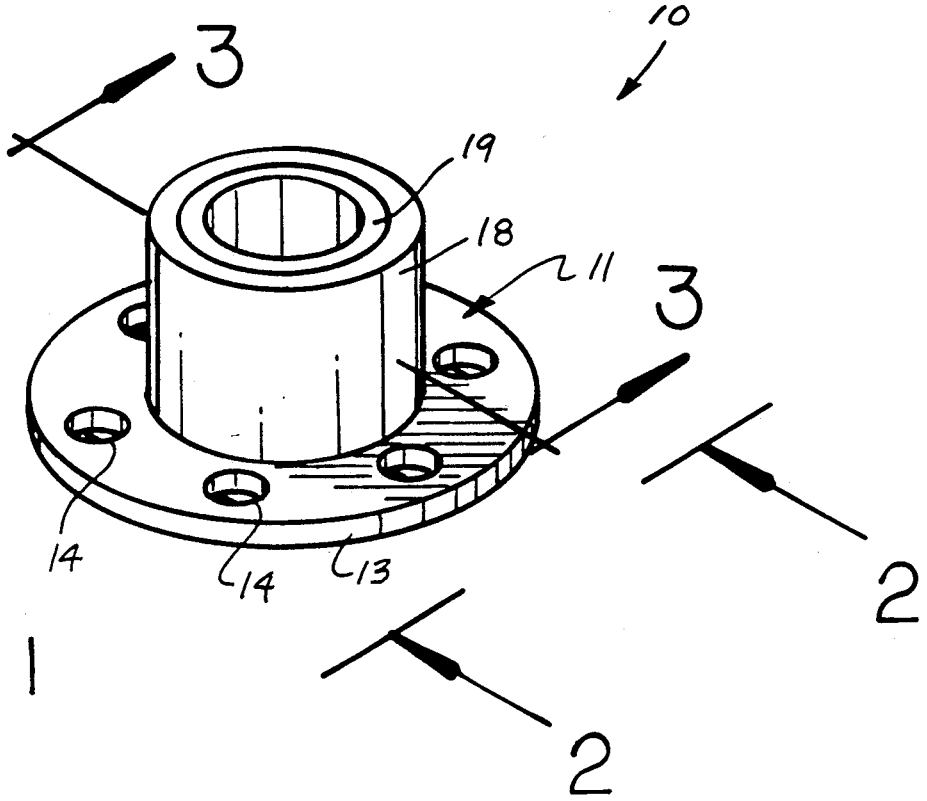
FIG. 1 is an isometric illustration of the invention.
Figure 2:
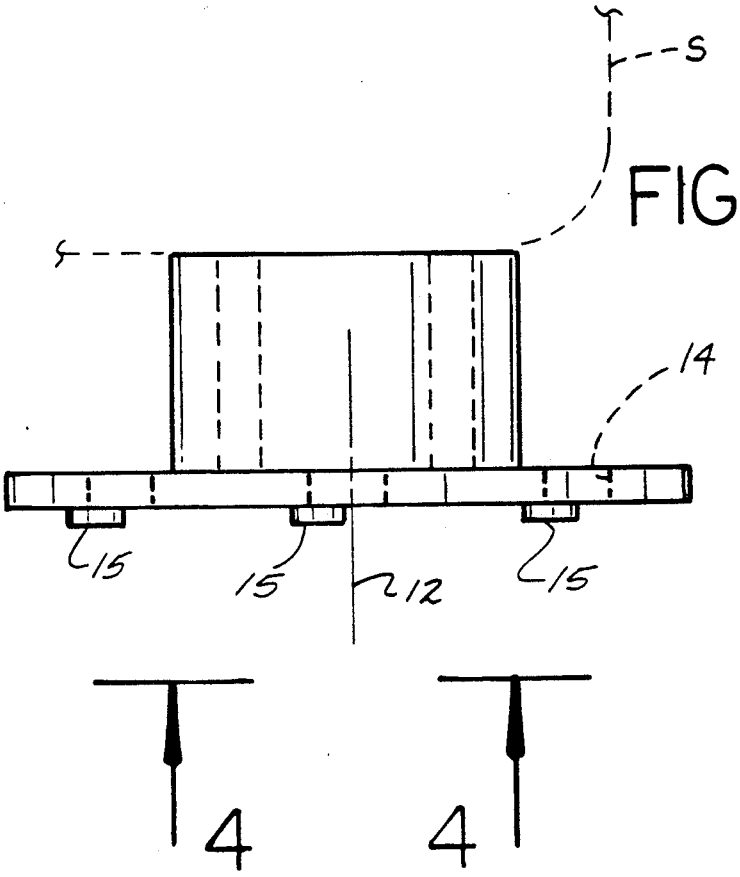
FIG. 2 is an orthographic view, taken along the lines 2—2 of FIG. 1 in the direction indicated by the arrows.

With reference now to the drawings, and in particular to FIGS. 1 to 8 thereof, a new and improved high heel shoe cap embodying the principles and concepts of the present invention and generally designated by the reference numerals 10 and 10*a* will be described.

More specifically, the high heel shoe cap 10 of the instant invention essentially comprises a base plate 11 symmetrically oriented about an axis 12, having a base plate peripheral side wall 13, with an annular array of openings 14 directed through the base plate in adjacency to the peripheral side wall 13. Each of the openings 14 includes a semicylindrical projection 15 fixedly mounted to the base plate bottom wall 16 extending in a partial extension over each entrance opening of each of the annular array of openings 14 such that each of the projections 15 includes a projection side wall 17 that are parallel relative to one another and orthogonally oriented relative to the axis 12, with the projection front wall 17 arranged to assist in engaging and providing traction to the cap structure 10. A rigid first tubular sleeve 18 is fixedly mounted to a top wall of the base plate 11 symmetrically oriented about the axis 12, with the first tubular sleeve 18 having a resilient second tubular sleeve 19 coextensive with the first tubular sleeve 18 concentric relative to the axis 12 positioned in contiguous orientation to the interior surface of the first sleeve 18, wherein the second tubular sleeve 19 is arranged to receive and engage the heel portion of a shoe "S" having a conventional high heel portion (not shown) to provide for the extended support of the shoe "S" when traversing water moistened turf and soil.

The modified cap structure 10*a*, as indicated in FIG. 5 for example, includes exteriorly oriented threads 20 positioned coextensively about the exterior surface of the modified first tubular sleeve 18, with a disc plate 21 threadedly received about the modified first tubular sleeve 18*a*, with the disc plate 21 having a disc plate periphery 22 extending beyond the base plate peripheral side wall 13. An array of spike members 23 orthogonally oriented relative to the disc plate 21 and parallel to the axis 12 and concentric relative to the axis 12 extend beyond the base plate bottom wall, as illustrated in FIG. 6, to provide for adjustable engagement of underlying turf. The degree of projection relative to the base plate 11 and its associated bottom wall is optional and as illustrated, the disc plate 21 is arranged for removal if desired from about the modified first tubular sleeve 18*a*.

Figure 7:
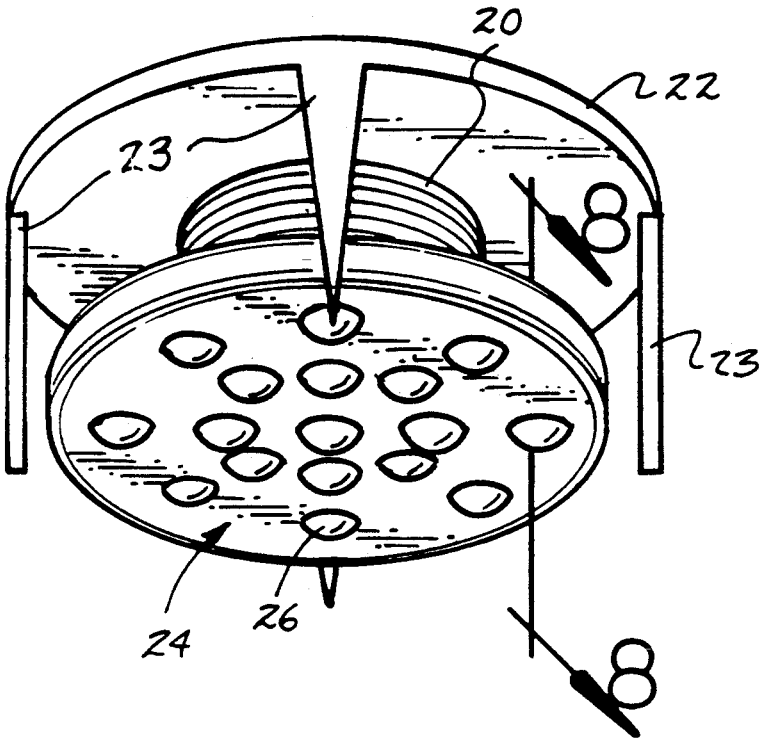
FIG. 7 is an isometric aspect of the invention further including a snap-on housing structure.
Figure 8:
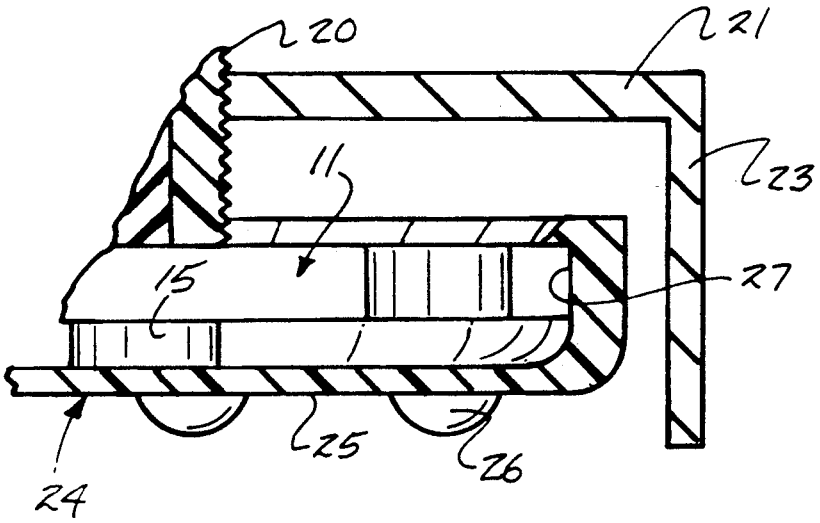
FIG. 8 is an orthographic view, taken along the lines 8—8 of FIG. 7 in the direction indicated by the arrows.

Further, as illustrated in FIGS. 7 and 8, the structure is arranged to include a resilient snap-on housing 24, having a housing bottom wall 25 to include a plurality of bottom wall projections 26 for use in lieu of the semicylindrical projections 15, such that the bottom wall projections 26 are of resilient construction for use in an exterior environment and may be worn interiorly without damage to floor surfaces. The snap-on housing 24 includes a housing resilient and cylindrical side wall channel 27 arranged to provide for a snap-in resilient securement about the base plate peripheral side wall 13, in a manner as indicated in FIG. 8, to permit ease of mounting and dismounting of the housing structure 24 relative to the base plate 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A high heel shoe cap, comprising, a base plate, the base plate symmetrically oriented about a predetermined axis, with the base plate including a base plate peripheral side wall, with an annular array of openings directed through the base plate in adjacency to the side wall symmetrically oriented relative to the axis, and the base plate including a base plate top wall and a base plate bottom wall, with the base plate top wall having a rigid first tubular sleeve mounted concentric relative to the axis, with a resilient second tubular sleeve mounted within the first tubular sleeve in contiguous communication with the first tubular sleeve and coextensive with the first tubular sleeve for receiving a high heel portion of a shoe member therewithin, and the base plate bottom wall includes a plurality of semi-cylindrical projections fixedly mounted to the bottom wall, with an individual of said semi-cylindrical projections mounted in a partial covering of an individual one of said openings, wherein each of the projections includes a projection front wall, wherein each projection front wall is arranged in a parallel relationship relative to one another.

2. A high heel shoe cap as set forth in claim 1 wherein the first tubular sleeve includes a threaded exterior surface, and a disc plate threadedly received onto the threaded exterior surface, wherein the disc plate is concentric relative to the axis and arranged for adjustment along the exterior surface, the disc plate having a disc plate periphery and the disc plate periphery including a plurality of spike members fixedly and orthogonally mounted to the disc plate extending beyond the base plate peripheral side wall, wherein the spike members are arranged for selective projection relative to the base plate bottom wall as the disc plate is adjusted along the first tubular sleeve.

3. A high heel shoe cap as set forth in claim 2 including a resilient snap-on housing, having a housing bottom wall and a housing resilient side wall channel arranged to receive the base plate peripheral side wall therewithin, wherein the housing bottom wall includes a plurality of resilient bottom wall projections.

* * * * *